United States Patent [19]

Katayama et al.

[11] Patent Number: 4,783,360

[45] Date of Patent: Nov. 8, 1988

[54] THERMAL TRANSFER MATERIAL

[75] Inventors: Masato Katayama; Kazumi Tanaka, both of Yokohama; Hiroshi Sato, Hiratsuka, all of Japan

[73] Assignee: Canon Kabushiki Kaisha, Tokyo, Japan

[21] Appl. No.: 885,657

[22] Filed: Jul. 15, 1986

[30] Foreign Application Priority Data

| | | | |
|---|---|---|---|
| Jul. 22, 1985 | [JP] | Japan | 60-160326 |
| Jul. 22, 1985 | [JP] | Japan | 60-160327 |
| Jul. 22, 1985 | [JP] | Japan | 60-160328 |
| Jul. 23, 1985 | [JP] | Japan | 60-161050 |
| Jul. 23, 1985 | [JP] | Japan | 60-161051 |
| Jul. 23, 1985 | [JP] | Japan | 60-161052 |
| Sep. 2, 1985 | [JP] | Japan | 191847 |

[51] Int. Cl.[4] ..... B41M 5/26

[52] U.S. Cl. ..... 428/212; 428/195; 428/206; 428/211; 428/323; 428/327; 428/484; 428/488.1; 428/488.4; 428/913; 428/914

[58] Field of Search ..... 428/206, 488.1, 488.4, 428/913, 914, 195, 211, 212, 323, 327, 484

[56] References Cited

U.S. PATENT DOCUMENTS

| | | | |
|---|---|---|---|
| 4,564,534 | 1/1986 | Kushida . | |
| 4,739,338 | 4/1988 | Tanaka | 346/1.1 |

FOREIGN PATENT DOCUMENTS

| | | | |
|---|---|---|---|
| 995008 | 8/1976 | Canada . | |
| 0163297 | 12/1985 | European Pat. Off. | 428/913 |
| 0185191 | 11/1982 | Japan | 428/913 |
| 0045993 | 3/1983 | Japan | 428/913 |
| 0201894 | 11/1984 | Japan | 428/913 |
| 0860590 | 2/1961 | United Kingdom | 428/913 |
| 1013101 | 12/1965 | United Kingdom | 428/913 |
| 1265527 | 3/1972 | United Kingdom | 428/913 |
| 1362475 | 8/1974 | United Kingdom | 428/913 |
| 1419804 | 12/1975 | United Kingdom | 428/913 |
| 1451671 | 10/1976 | United Kingdom | 428/913 |
| 1504338 | 3/1978 | United Kingdom | 428/913 |
| 2161950 | 1/1986 | United Kingdom | 428/913 |

*Primary Examiner*—Ellis P. Robinson
*Assistant Examiner*—P. R. Schwartz
*Attorney, Agent, or Firm*—Fitzpatrick, Cella, Harper & Scinto

[57] ABSTRACT

A thermal transfer material, comprising: a support, and a first ink layer and a second ink layer respectively containing a heat-fusible material disposed in the order named on the support. The second ink layer includes domains of at least two species. The thermal transfer material provides a transfer image of high density and clear edges even on a recording medium having poor surface smoothness.

11 Claims, 3 Drawing Sheets

THERMAL TRANSFER MATERIAL

BACKGROUND OF THE INVENTION

The present invention relates to a thermal heat-sensitive transfer material which can give transferred recorded images of good printed letter quality even on a recording medium with poor surface smoothness and a process for production thereof The thermal or heat-sensitive transfer recording method has advantageous features that it does not require converted ("treated") paper and provides recorded images with excellent durability in addition to the general features of the thermal recording method that the apparatus therefor is light in weight, compact, free of generating noise and also excellent in operability and maintenance. For these reasons the thermal transfer recording method has been recently widely used.

The thermal transfer recording method employs a thermal transfer material, comprising generally a heat transferable ink containing a colorant dispersed in a heat-fusible binder applied on a support generally in the form of a sheet. The thermal transfer material is superposed on the recording medium so that the heat-transferable ink layer may contact the recording medium, and the ink layer, melted by supplying heat by a thermal head from the support side of the thermal transfer material, is transferred onto the recording medium, thereby forming a transferred ink image corresponding to the pattern of the heat supplied on the recording medium.

However, the thermal transfer recording method of the prior art involves some drawbacks. That is, according to the thermal transfer recording method of the prior art, the transfer recording performance, namely printed letter quality is greatly influenced by the surface smoothness, and therefore, although good quality of letter printing can be effected on a recording medium with high smoothness, the printed letter quality will be markedly lowered on a recording medium with poor smoothness. For this reason, a paper having a high surface smoothness is generally used. However, a paper with a high smoothness is rather special and the papers in general possess various degrees of concavities and convexities due to entanglement of fibers. Accordingly, in the case of a paper with a large surface unevenness, the heat-molten ink cannot penetrate into the fibers of the paper during transfer printing, but caused to adhere only at the convexities of the surface or in the vicinity thereof, with the result that the image printed at the edge portion is not sharp or a part of the image may be lacking to lower the printed letter quality. For improvement of the printed letter quality, there has been taken a measure of using a heat-fusible ink having a low melting point at least in the surface layer, or increasing the thickness of the heat-transferable ink layer based on a concept of causing the melted ink to penetrate faithfully into the surface unevenness of paper, etc. When an ink having a low melting point is used, however, the heat transferable ink layer will be sticky at a relatively low temperature to result in lowering in storability or troubles such as staining at non-printed portions of the recording medium or blurring of transferred images. Further, in a case where a transferable ink layer having a large thickness is used, blurring becomes remarkable and a large amount of heat supply from a thermal head is required to lower the printing speed.

SUMMARY OF THE INVENTION

An object of the present invention is to remove the drawbacks of the prior art and provide a heat-sensitive transfer material capable of giving printed letters or transferred images of high density and clear edges not only on a recording medium having good surface smoothness but also on a recording medium having poor surface smoothness.

Another object of the present invention is to provide a process for advantageously producing a thermal transfer material with excellent characteristics as described above.

According to the present invention, there is provided a thermal transfer material comprising: a support, and a first ink layer and a second ink layer respectively containing a heat-fusible material disposed in the order named on the support; the second ink layer comprising domains of at least two species.

The present invention further provides a process for producing a thermal transfer material comprising a support, and a first ink layer and a second ink layer disposed in the order named on the support, the second ink layer comprising domains of at least two species; wherein the second ink layer is formed by applying a coating liquid containing a mixture of at least two species of heat-fusible resin particles and drying the applied coating liquid.

These and other objects, features and advantages of the present invention will become more apparent upon a consideration of the following description of the preferred embodiments of the present invention taken in conjunction with the accompanying drawings, wherein like parts are denoted by like reference numerals.

DETAILED DESCRIPTION OF THE INVENTION

In the thermal transfer material according to the present invention, the second ink layer comprises domains of two or more species of a heat-fusible material, so that the cohesion in the ink layer can be reduced compared with that in a homogeneous system. The domains of at least two species, when heated in a pattern, cause fusion and uniformization to produce an adhesion of a recorded image onto a recording medium and form a recorded image of a high cohesion. Furthermore, there are domains of at least two species having different functions or physical properties such as adhesion and cohesion on heating, so that a state is formed wherein respective functions or physical properties can be readily developed compared with a case of a uniform system. In this way, in the second ink layer, there occurs a large difference in cohesion between a heated portion (pattern-heated portion) and a non-heated portion, so that cutting of printed images is remarkably promoted to provide a clear transfer recorded image.

Further, the first ink layer has a function of controlling and suppressing the viscous adhesion of the second ink layer onto the support on heat application. More specifically, the recording image or heated ink pattern, due to the combination of an enhanced film strength in a pattern onto a recording medium and a weak adhesion onto the support controlled by the first ink layer, provides a relationship especially suited for transfer of the recording image onto the recording medium (formation of transfer recorded image). Because of improvement in film strength of a recorded image, the recorded image is not cut even on the surface unevenness of a recording medium to avoid lacking of the recorded image.

Further, because of improvement in cohesion and adhesion of the ink layer in the pattern-heated portion, sharp edge cutting is remarkably promoted. As a result, the thermal transfer material according to the present invention provides a transfer recorded image of a good printing quality even on a recording medium having a poor surface smoothness.

The present invention will be explained in further detail hereinbelow. In the following description, "%" and "parts" representing quantity ratios are by weight unless otherwise noted specifically.

Figure 1:
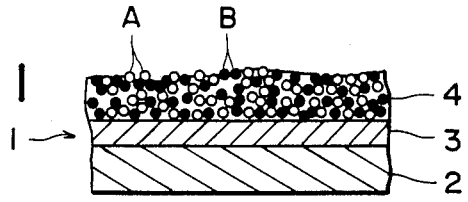
FIGS. 1 through 12 are schematic views each showing a section across the thickness of an example of the thermal transfer material according to the present invention.
Figure 2:
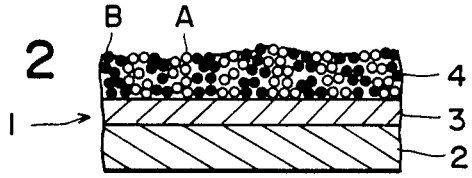

FIGS. 1 and 2 are respectively a schematic sectional view of an example of the thermal transfer material according to the present invention.

The term "domain" used herein refers to a region which can be discriminated from the other in a heterogeneous system in respect of composition, physical property, etc.

In a second ink layer 4 of a thermal transfer material 1 in FIGS. 1 and 2, each domain A or B is composed of a single or plural heat-fusible resin particles.

Referring to FIGS. 1 and 2, a thermal transfer material comprises a support 2 ordinarily in the form of a sheet, and a first ink layer 3 and a second ink layer 4 respectively comprising a heat-fusible material and disposed in that order on the support 2.

The first ink layer 3 comprises a heat-fusible material constituting a homogeneous system, e.g., a non-particulate heat-fusible binder.

The second ink layer 4 comprises, e.g., two species, i.e., species A denoted by white circles and species B denoted by black circles, of heat-fusible resin particles. More specifically, in the example of FIG. 1, a single heat-fusible resin particle of species A or species B form a domain. In the example of FIG. 2, each domain is composed of an aggregate of plural heat-fusible resin particles of species A or species B.

Incidentally, the term "heat-fusible" used herein refers to a property of becoming a liquid or softening on heat-application to develop a viscosity or an adhesion.

In the thermal transfer materials shown in FIGS. 1 and 2, the weight proportions between the different species of heat-fusible resin particles constituting the second ink layers may be arbitrarily selected depending on the functions and physical properties possessed by the respective species and need not be particularly limited. However, in order to sufficiently exhibit the effect of the combination, domains of two or more species may preferably have a composition comprising 100 parts of one species and 2–100 parts, particularly 5–100 parts of the other species.

Figure 3:
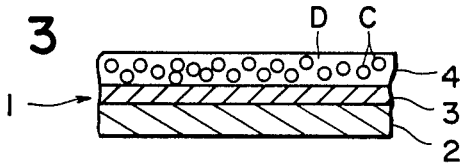
Figure 4:
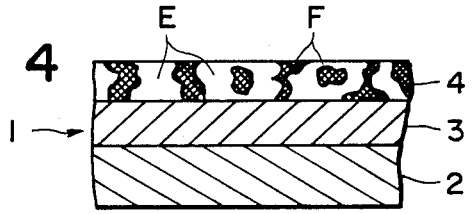

In the examples shown in FIGS. 1 and 2, the respective domains retain a particle characteristic, whereas as shown in examples of FIGS. 3 and 4, it is possible that at least one species of domain has lost its particle characteristic.

In the example of the thermal transfer material shown in FIG. 3, the second ink layer 4 comprises heat-fusible resin particles C and a non-particulate phase D respectively forming at least one domain. A single heat-fusible resin particle C may constitute a domain, or alternatively an aggregate of particles C may constitute a domain. Further, it is possible to form domains of two or more species by using different kinds of heat-fusible resin particles C. In this case, by using different kinds of particles, there is formed a state wherein domains with different functions or physical properties such as adhesion and cohesion on heating are formed, so that the respective functions or physical properties may be readily developed. Similarly, the non-particulate phase D can constitute two or more species of domains, e.g., as those obtained through phase separation.

The weight proportions between the heat-fusible resin particles and the non-particulate phase constituting the second ink layer may be arbitrarily determined, but it is preferred to use 2 to 400 parts, particularly 5–200 parts of the non-particulate phase with respect to 100 parts of the heat-fusible resin particles.

In the example of the thermal transfer material shown in FIG. 4, the second ink layer comprises two kinds of non-particulate phases of species E (shown in white in the figure) and species F (shown in black) respectively forming domains.

The non-particulate phases E and F of the thermal transfer material shown in FIGS. 3 and 4 may be composed from a heat-fusible material constituting a homogeneous system, e.g., a non-particulate heat-fusible binder, constituting the first ink layer as will be described hereinafter.

The proportions of the different species of non-particulate phases constituting the second ink layer 4 may be arbitrarily selected depending on the functions and physical properties possessed by the respective phases and need not be particularly limited. However, in order to sufficiently exhibits the effect of the combination, domains of two or more species may preferably have a composition comprising 100 parts of one species and 2–100 parts, particularly 5–100 parts of the other species.

Further, it is possible to constitute the first ink layer 3 as a layer comprising heat-fusible resin particles as shown in FIGS. 5–9, instead of a homogeneous system of a heat-fusible material. By constituting the first ink layer 3 in this way, it becomes possible to use a material of a high cohesion which cannot be used in a homogeneous system. Further, as the layer is constituted by particles, the difference in cohesion becomes pronounced on heat application to provide a sharp recorded image of good edge sharpness.

Figure 5:
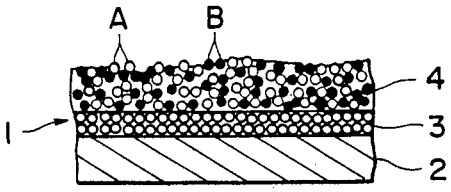

The thermal transfer material 1 shown in FIG. 5 comprises a first ink layer 3 of one or two or more species of heat-fusible resin particles, and a second ink layer 4 which is similar to the second ink layer 4 shown in FIG. 1.

Figure 6:
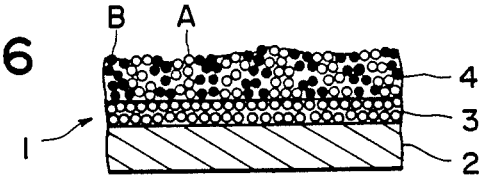

The thermal transfer material 1 shown in FIG. 6 comprises a first ink layer 3 of one or two or more species of heat-fusible resin particles similarly as shown in FIG. 5, and a second ink layer 4 which is similar to the second ink layer shown in FIG. 2.

Figure 7:
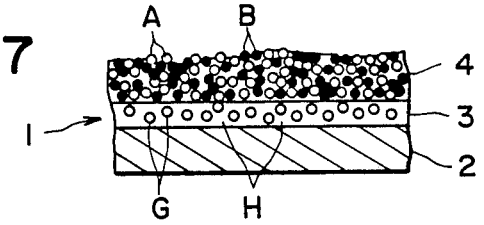

The thermal transfer material 1 shown in FIG. 7 has a first ink layer 3 which comprises heat-fusible resin particles G and a non-particulate phase H of a heat-fusible binder. The second ink layer 4 is similar to the one shown in FIG. 1.

The thermal transfer material 1 shown in FIG. 7 has a first ink layer 3 which is similar to the one shown in FIGS. 5 and 6. The second ink layer 4 is similar to the one shown in FIG. 3.

Figure 9:
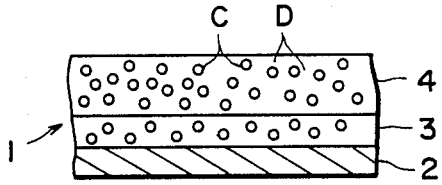

The thermal transfer material 1 shown in FIG. 9 has a first ink layer 3 which is similar to the one shown in FIG. 7. The second ink layer 4 is similar to the one shown in FIG. 3.

The heat-fusible resin particles and the heat-fusible binder used in the thermal transfer materials shown in FIGS. 5–9 may respectively comprise one or two or more species.

The second ink layer has a function of forming a latent image through fusion of particles on heat application and also a function of exhibiting on heating an adhesion onto a recording medium.

The heat-fusible resin particles and heat-fusible binder used in the second ink layer may be composed of resins selected from those described hereinafter. In this case, the resin for the second ink layer can be the same as the one constituting the first ink layer but may preferably be an appropriately different one so as to show a higher viscous adhesion onto a recording medium than the first ink layer and provide a relationship desirable for transfer of a heated ink pattern onto a recording medium and formation of a recorded image.

In view of the relationship of the film thickness formed after heating and the adhesion on heating, the combination of the two or more species of particles or binders constituting the second ink layer may preferably be a combination selected from those listed below. Thus, wax or polyolefin resin such as low-molecular weight polyethylene-polyurethane resin, polyolefin resin-polyvinyl acetate resin, ethylene/vinyl acetate resin-styrene/butadiene resin, and a ternary system such as acrylic resin-polyvinyl acetate resin-petroleum resin.

The proportions of domains in the second ink layer may change depending on the respective functions and physical properties and are not particularly restricted.

Figure 10:
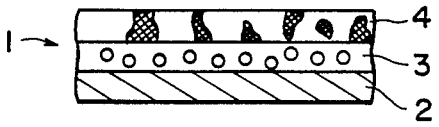

The thermal transfer material 1 shown in FIG. 10 has a first ink layer 3 which is similar to the one shown in FIG. 7. The second ink layer 4 is similar to the one shown in FIG. 4.

Further, the first ink layer 3 may be composed of a plurality of non-particulate phases instead of using a layer containing heat-fusible resin particles.

Figure 11:
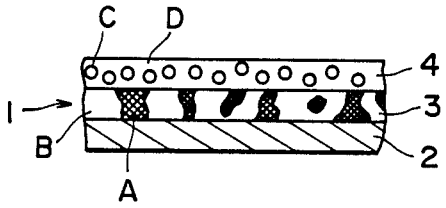

The thermal transfer material 1 shown in FIG. 11 has a first ink layer 3 which comprises two non-particulate phase of, e.g., heat-fusible binders. The second ink layer 4 is similar to the one shown in FIG. 7.

In the thermal transfer materials shown in FIGS. 10 and 11, the heat-fusible resin particles and the heat-fusible binder may respectively comprise one or two or more species.

Figure 12:
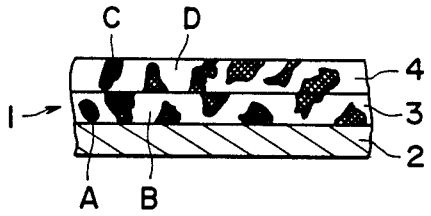

The thermal transfer material 1 shown in FIG. 12 comprises a first ink layer 3 and a second ink layer 4 which respectively comprise two non-particulate phases of, e.g., non-particulate heat-fusible binders.

The combination of the two or more species of the heat fusible material constituting the second ink layer 4 should preferably be selected from those described above.

In the examples of the thermal transfer material according to the present invention explained with reference to FIGS. 1–12, at least one of the first ink layer 3 and the second ink layer 4 contains a colorant as desired, and the respective layers may contain various additives such as a plasticizer and an oil.

As the support 2, it is possible to use fills or papers known in the art as such. For example, films of plastics having relatively good heat resistance such as polyester, polycarbonate, triacetylcellulose, polyphenylene sulfide, polyimide, etc., cellophane parchment paper or capacitor paper, can be preferably used. The support should have a thickness desirably of 1 to 15 microns when a thermal head is used as a heating source during heat transfer, but it is not particularly limited when using a heating source capable of heating selectively the heat-transferable ink layer, such as a laser beam. Also, in the case of using a thermal head, the surface of the support to contact the thermal head can be provided with a heat-resistant protective layer comprising a silicone resin, a fluorine-containing resin, a polyimide resin, an epoxy resin, a phenolic resin, a melamine resin, an acrylic resin or nitrocellulose to improve the heat resistance of the support. Alternatively, a support material which could not be used in the prior art can also be used by provision of such a protective layer.

The heat fusible binder constituting the first ink layer and the second ink layer may include waxes such as carnauba wax, paraffin wax, sasol wax, microcrystalline wax, and castor wax; higher fatty acids and their derivatives inclusive of salts and esters such a stearic acid, palmitic acid, lauric acid, aluminum stearate, lead stearate, barium stearate, zinc stearate, zinc palmitate, methyl hydroxystearate, and glycerol monohydroxystearate; polyamide resin, polyester resin, very high molecular weight epoxy resin, polyurethane resin, acrylic resin (polymethyl methacrylate, polyacrylamide, etc.); vinyl-type resins such as vinyl acetate resin, polyvinyl pyrrolidone, and polyvinyl chloride resin (e.g., vinyl chloride-vinylidene chloride copolymer, vinyl chloride-vinyl acetate copolymer, etc.); cellulose resins (e.g., methylcellulose, ethylcellulose, carboxycellulose, etc.), polyvinyl alcohol resin (polyvinyl alcohol, partially saponified polyvinyl acetate, etc.), petroleum resins, terpene resins, rosin derivatives, coumarone-indene resin, novalak-type phenol resin, polystyrene resins, polyolefin resins (polyethylene, polypropylene, polybutene, ethylene-vinyl acetate copolymer, etc.), poyvinyl ether resin, polyethylene glycol resin, elastomers, natural rubbers, styrene-butadiene rubber, and isoprene rubber.

The softening temperature of the heat-fusible binder may be 40°–150° C., preferably 60°–140° C. The melt viscosity may preferably be 2–20 million centipoises as measured by a rotary viscometer at 150° C.

Examples of the heat-fusible resin constituting the heat-fusible resin particles include waxes, polyolefin resins such as low-molecular weight polyethylene, polyamide resins, polyester resins, epoxy resins, polyurethane resins, acrylic resins, polyvinyl chloride resins, polyvinyl acetate resins, petroleum resins, phenolic resins, polystyrene resins, and elastomers such a styrene-butadiene rubber and isoprene rubber.

The heat-fusible resin particles may be resin particles having a softening temperature of 50°–160° C., preferably 60°–150° C., selected from those prepared through various processes including polymerization processes such as emulsion polymerization and suspension polymerization, a process for mechanically dispersing a heat-fusible resin in the presence of a dispersant, mechanical pulverization, spray drying, precipitation, etc. Herein, the softening temperature refers to a flow initiation temperature as measured by means of Shimazu Flow Tester, model CFT-500 under the conditions of a load of 10 kg and a temperature raising rate of 2° C./min.

The two or more species of domains when contained in a layer of the first ink layer or the second ink layer, either particular or non-particulate, may preferably have a difference in softening temperature of 5° C. or more, particularly 10° C. or more, between the highest and the lowest.

The heat-fusible resin particles should preferably have an average particle size of 20 microns or less (down to the order of 0.01 micron), particularly 10 microns or less (down to the order of 0.1 micron). Above 20 microns, the particle size can reach the ink layer thickness. In this case, some voids are liable to remain in the heated ink pattern when heated to cause fusion on heat application to result in poor transferability. For this reason, it is not desirable that the particle size and the ink layer thickness are of the same order.

It is preferred that the first ink layer has a thickness of 0.5–10 microns, and the second ink layer has a thickness of 0.5–20 microns, particularly 1–10 microns. Further, the total thickness of the first and second ink layers should preferably be 2–25 microns. If the second ink layer thickness is below 0.5 micron, the film strength of the heated ink pattern becomes too small, whereas the thickness above 20 microns causes difficulty in forming a uniform film.

The colorant may be one or two or more species selected from all of the known dyes and pigments including: carbon black, Nigrosine dyes, lamp black, Sudan Black SM, Alkali Blue, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 20, Lake Red C, Rhodamine FB, Rhodamine B Lake, Methyl Violet B Lake, Phthalocyanine Blue, Pigment Blue, Brilliant Green B, Phthalocyanine Green Oil Yellow GG, Zapon Fast Yellow CGG, Kayaset Y963, Kayaset YG, Smiplast Orange G, Orasol Brown B, Zapon Fast Scarlet CG, Aizen Spiron Red BEH, Oil Pink OP, Victoria Blue F4R, Fastgen Blue 5007, Sudan Blue, and Oil Peacock Blue. These colorants may preferably be used in a proportion of 3 to 300 parts per 100 parts of the heat-fusible material.

It is sufficient that the colorant is contained in at least one of the first and second ink layers. However, in a case where the second ink layer contains no colorant and only the first ink layer contains a colorant, it is easy to correct a recorded image after transfer which has been recorded in error, since the second ink layer contacting the recording medium contains no colorant.

The first ink layer 3 shown in FIGS. 1–4 may be formed by selecting one or two or more of the above mentioned heat-fusible binders and applying them together with optionally added-colorant and other additives through hot-melt coating, solvent coating, etc.

The first ink layer or the second ink layer in a structure containing heat-fusible resin particles may for example be formed by selecting two or more species of heat-fusible resin particles selected from those enumerated above, appropriately mixing the particles, uniformly dispersing the particles on the first ink layer, and heating the particles to a temperature not higher than the softening temperature of the particles to cause the particles to adhere onto the support or the first ink layer. Alternatively, the first or second ink layer (e.g., the second ink layer shown in FIG. 1 or 2) may be formed by applying a coating liquid containing preliminarily prepared heat-fusible resin particles dispersed in a poor solvent and then removing the solvent; or by dissolving a binder resin in the dispersing medium of the dispersion containing the particles to form a coating liquid, applying the liquid and removing the dispersing medium to form a layer wherein the particles are appropriately dispersed in the binder.

Figure 8:
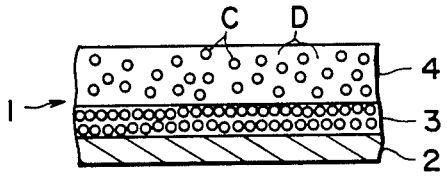

Most suitably, the first ink layers shown in FIGS. 5, 6 and 8 and the second ink layers shown in FIGS. 1, 2 and 5–7 may be formed by using one or two or more species of resin emulsion to form a coating liquid, applying the liquid and drying the coating liquid at a temperature below the softening temperature of the resin particles resulting from the emulsion. Further, the first ink layers shown in FIGS. 7, 9 and 10 and the second ink layers shown in FIGS. 3, 8, 9 and 11 may be formed by using two or more species of resin emulsion to form a coating liquid, applying the coating liquid, and after the application, drying the coating liquid at a temperature between the lowermost softening temperature and the uppermost softening temperature of the two or more species of the resin particles resulting from the emulsion to remove the dispersing medium, thereby to form a layer wherein a part of the particles retain their particle form and the other part of the particles form a non-particulate phase.

Further, a layer composed of different non-particulate phases like the second ink layer in FIG. 4, the second ink layer in FIG. 10, the first ink layer in FIG. 11, and the first and second ink layers in FIG. 12, may for example be formed by dispersing in a solution of a heat-fusible binder a pulverized prduct of a heat-fusible material insoluble in the solvent of the solution, and applying the dispersion to form a coating layer, followed by drying and fusion through heating; or by forming a coating formulation of a combination of mutually incompatible heat-fusible binders such a ethylene/vinyl acetate copolymer resin and vinyl acetate resin or cellulose resin and acrylic resin through hot-melt mixing or solution mixing, applying the formulation and causing phase separation, if necessary, on heating.

As a method different from those described above, it is particularly preferred to form such a layer by mixing dispersion liquids of two or more species of heat-fusible resin particles, e.g., in the form of resin emulsions, applying the mixture to form a coating, and drying the coating at a temperature higher than the uppermost temperature of the two or more species of the resin particles. In this case, optional colorant, additive, etc., may be contained in the dispersion or the particles.

It is possible to form a first ink layer and a second ink layer, wherein at least one of the first and second ink layers comprises two or more species of domains heat-fusible materials, and at least one species of domain comprises oxidized polyethylene having a number-average molecular weight of 1300 or higher, preferably 2000–10000, so as to provide a large difference in cohesion between the heated portion and the non-heated portion. It is however preferred that at least the second ink layer comprises such two or more species of domains of heat fusible materials as shown in FIGS. 1–12, in respect of providing clearer recorded images.

If the oxidized polyethylene has a number-average molecular weight of below 1300, the film strength of the resultant transferred image after heating is lowered.

The oxidized polyethylene may be contained in any species of the domains constituting a heat-transferable ink layer, and may be contained in two or more species of the domains. The oxidized polyethylene may preferably be contained in an amount of 30% or more of the total amount of the heat-fusible material contained in the heat-transferable ink layers so that the effect thereof is sufficiently exhibited.

The oxidized polyethylene may be obtained by oxidizing a linear or branched low-molecular weight polyethylene obtained through, e.g., a high temperature-high pressure polymerization process, a low pressure polymerization process using a Ziegler catalyst, or thermal decomposition of polyethylene for general molding purpose. The oxidized polyethylene may have a structure including a repeating unit of $+CH_2—CH_2+$ and also a functional group such as a carboxyl group or hydroxyl group introduced thereinto. The oxidized polyethylene may practically have an acid value of the order of 10–40 mgKOH/g measured according to ASTM D1386. Examples of the commercially available products include Hoechst Wax PED-121, PED-153, PED-521, PED-522 (mfd. by Hoechst A.G.); A-C Polyethylene 629, 680, 330, 392, 316 (mfd. by Allied Chemical Corp); and Mistui Hi-Wax 4202 E. The oxidized polyethylene particles may be used in the form of an aqueous dispersion which has been prepared by dispersing the oxidized polyethylene under an elevated pressure and an elevated temperature in the presence of an emulsifier such as a surfactant or an alkali.

Another heat-fusible material to be combined with the above mentioned oxidized polyethylene may preferably be selected so as to provide a high adhesion on heating onto a recording medium and a preferred relationship for transfer of a heated ink pattern onto a recording medium and formation of a recorded image.

For this purpose, in view of the relationship between the film strength of the heated ink pattern and the adhesion on heating, examples of the preferred combination include: oxidized polyethylene-ethylene/vinyl acetate copolymer resin, oxidized polyethylene-polyvinyl acetate resin, oxidized polyethylene-polyurethane resin, oxidized polyethylene-acrylic resin, oxidized polyethylene-styrene/butadiene resin, and a ternary system of oxidized polyethylene-polyvinyl acetate resin-petroleum resin.

The shape of the heat-sensitive transfer material of the present invention is not particularly limited as far as it is basically planar, but it is generally shaped in the form of a tape or ribbon as in a typewriter ribbon or a tape with wide width as used in line printers, etc. Also, for the purpose of color recording, the heat-sensitive transfer material of the inventions can be formed by applying several kinds of color tones of heat-fusible inks in stripes or blocks on a support.

Operation for the thermal transfer recording method employing the above explained thermal transfer material is not particularly different from that of the conventional method. The heat source for the thermal transfer recording may be a thermal head, a laser beam, etc.

Hereinbelow, the present invention will be explained more specifically while referring to specific examples of practice. Incidentally, the number-average molecular weight of a resin such as oxidized polyethylene was measured in the following manner.

[Molecular Weight Measurement]

The VPO method (Vapor Pressure Osmometry Method) is used. A sample polymer is dissolved in a solvent such as benzene at various concentrations (C) in the range of 0.2 to 1.0 g/100 ml to prepare several solutions. The osmotic pressure ($\pi/C$) of each solution is measured and plotted versus the concentration to prepare a concentration (C)-osmotic pressure ($\pi/C$) curve, which is extrapolated to obtain the osmotic pressure at the infinite dilution $(\pi/C)_0$. From the equation of $(\pi/C)_0=RT/Mn$, the number average molecular weight Mn of the sample is derived.

EXAMPLE 1

| <Ink 1> | |
|---|---|
| Carbon black | 15 parts |
| Montan wax | 15 parts |
| Paraffin wax | 50 parts |
| Low-molecular weight ethylene-vinyl acetate copolymer | 20 parts |

The above components were mixed in a sand mill for 30 minutes while being heaed at 120° C. for dispersing the carbon black to prepare an ink 1.

A 3.5 micron-thick polyester support provided with a heat-resistant protective layer formed by applying an addition-type silicone resin for release paper at a rate of 0.3 g/m$^2$ followed by drying was provided, and the ink 1 was applied by hot-melt coating with a wire bar onto a side of the polyester support opposite to that provided with the heat-resistant protective layer to form a first ink layer.

| <Ink 2> | |
|---|---|
| Wax emulsion (Softening temp.: 80° C., average particle size: 1 micron) | 70 parts |
| Acryl-styrene copolymer emulsion (Softening temp.: 95° C., average particle size: about 0.2 micron) | 30 parts |
| Fluorine-containing surfactant | 1 part |

(The amounts of aqueous emulsions, dispersions or solutions for providing an ink formulation in this example and the other examples are all expressed based on their solid contents.)

The above components were sufficiently mixed. under stirring to prepare an ink 2 of a solid content of 25%.

The ink 2 was applied on the first ink layer provided above by means of an applicator, followed by drying at 60° C. to form a 3 micron-thick second ink layer. Thus, a thermal transfer material (A) was obtained.

COMPARATIVE EXAMPLE 1

| <Ink 3> | |
|---|---|
| Polyamide resin (Softening temp.: 90° C.) | 100 parts |
| Isopropyl alcohol | 400 parts |

A thermal transfer material (B) was prepared in the same manner as in Example 1 except that an ink 3 of the above composition instead of the ink 2 was applied on the first ink layer to form a 3 micron-thick second ink layer.

The thus obtained thermal transfer materials (A) and (B) were subjected to thermal transfer recording under the following conditions:

Thermal head: Thin film head, 24 dot arrangement
1 Dot size: 0.14×0.15 mm
Dot spacing: 0.015 mm
Resistance of heat generating element: 315 Ω
Application voltage: 13.2 V
Application pulse duraton: 1.1 m.sec Recording paper: bond paper (Bekk smoothness=-7-8 sec.)

Printing and transfer characteristics were evaluated by observation with naked eyes. The results are summarized in the following Table 1.

TABLE 1

| | THERMAL TRANSFER MATERIAL | EDGE SHARPNESS OF PRINTED IMAGES | PRINTED IMAGE DENSITY | TRANSFER CHARACTERISTIC |
|---|---|---|---|---|
| EXAMPLE 1 | A | ○ | ○ | ○ |
| COMPARATIVE EXAMPLE 1 | B | X | Δ | Δ |

In the above table and the following tables, the symbols respectively have the following meaning:

○ : Excellent for practical use,

Δ: Applicable to practical use but poor in performance, and

X: Not appropriate to practical use.

EXAMPLE 2

| <Ink 4> | |
|---|---|
| Carbon black | 15 parts |
| Montan wax | 15 parts |
| Paraffin wax | 25 parts |
| Low-molecular weight oxidized polyethylene | 25 parts |
| Low-molecular weight ethylene-vinyl acetate copolymer | 20 parts |

The above components were mixed in a sand mill for 30 minutes while being heated at 100° C. for dispersing the carbon black to prepare an ink 4. The ink 4 was applied on a 3.5 micron-thick PET (polyethylene terephthalate) film by hot-melt coating with a wire bar to form a 1 micron-thick first ink layer.

| <Ink 5> | |
|---|---|
| 25% Low-molecular weight oxidized polyethylene aqueous dispersion (Softening temp.: 130° C., particle size: about 2 microns) | 50 parts |
| 20% Wax emulsion (Softening temp.: 70° C., particle size: about 1 micron) | 50 parts |

The above components were mixed to prepare an ink 5, which was then applied on the first ink layer prepared above by means of an applicator, followed by drying at 80° C. to form a 3 micron-thick second ink layer, whereby a thermal transfer material (C) was obtained.

In the second ink layer, particles of the low-molecular weight oxidized polyethylene were confirmed through microscopic observation.

EXAMPLE 3

| <Ink 6> | |
|---|---|
| 20% Wax emulsion (Softening temp.: 80° C., particle size: about 2 microns) | 70 parts |
| 15% Aqueous solution of water-soluble acrylic resin (Softening temp: 60° C.) | 30 parts |

A thermal transfer material (D) was prepared in the same manner as in Example 2 except that an ink 6 of the above composition instead of the ink 5 was applied on the first ink layer to form a 3 micron-thick second ink layer.

In the second ink layer, particles of the wax were confirmed through microscopic observation.

COMPARATIVE EXAMPLE 2

A thermal transfer material (E) was prepared in the same manner as in Example 2 except that the ink 3 used in Comparative Example 1 instead of the ink 5 was applied on the first ink layer to form a 3 micron-thick second ink layer.

The thus obtained thermal transfer materials (C), (D) and (E) were respectively subjected to thermal transfer recording under the same conditions as used in Example 1. Printing and transfer characteristics were, evaluated by naked eye observation, and the results are summarized in the following Table 2.

TABLE 2

| | THERMAL TRANSFER MATERIAL | EDGE SHARPNESS OF PRINTED IMAGES | PRINTED IMAGE DENSITY | TRANSFER CHARACTERISTIC |
|---|---|---|---|---|
| EXAMPLE 2 | C | ○ | ○ | ○ |
| EXAMPLE 3 | D | ○ | ○ | ○ |
| COMPARATIVE EXAMPLE 2 | E | X | Δ | Δ |

EXAMPLE 4

The ink 1 obtained in Example 1 was applied on a 3.5 micron-thick PET film by hot-melt coating with a wire bar to form a 1 micron-thick first ink layer.

| <Ink 7> | |
|---|---|
| Low-molecular weight oxidized polyethylene emulsion (Softening temp.: 95° C., particle size: about 0.7 micron) | 70 parts |
| Polyvinyl acetate emulsion (Softening temp.: 100° C., particle size: about 0.5 micron) | 30 parts |
| Fluorine-containing surfactant | 1 part |

The above components were mixed to prepare an ink 7, which was then applied on the first ink layer prepared above by means of an applicator, followed by drying at 105° C. to form a 3 micron-thick second ink layer, whereby a thermal transfer material (F) was obtained.

In the second ink layer, two species of nonparticulate phases were confirmed through microscopic observation.

EXAMPLE 5

| <Ink 8> | |
|---|---|
| 20% Wax emulsion (Softening temp.: 70° C.) | 50 parts |
| Pulverized polyamide resin (Softening temp.: 90° C., particle size: 2 microns) | 50 parts |
| Sodium dodecylbenzenesulfonate | 2 parts |
| Water | 198 parts |

An ink 8 of the above composition was prepared by dissolving the sodium dodecylbenzenesulfonate in the water, adding thereto the pulverized polyamide resin under stirring by means of a propeller-type stirrer, and adding and mixing therewith the wax emulsion.

The ink 8 was applied on the first ink layer provided in Example 4 by means of an applicator, followed by drying at 90° C. to form a 3 micron-thick second ink layer. Thus, a thermal transfer material (G) was obtained.

COMPARATIVE EXAMPLE 3

A thermal transfer material (H) was prepared by applying the ink 3 of Comparative Example 1, followed by drying to form a 3 micron-thick second ink layer on the first ink layer formed in Example 4.

The thus obtained thermal transfer materials (F), (G) and (H) were respectively subjected to thermal transfer recording under the same conditions as used in Example 1. Printing and transfer characteristics were evaluated by naked eye observation, and the results are summarized in the following Table 3.

TABLE 3

| | THERMAL TRANSFER MATERIAL | EDGE SHARPNESS OF PRINTED IMAGES | PRINTED IMAGE DENSITY | TRANSFER CHARACTERISTIC |
|---|---|---|---|---|
| EXAMPLE 4 | F | ○ | ○ | ○ |
| EXAMPLE 5 | G | ○ | ○ | ○ |
| COMPARATIVE EXAMPLE 3 | H | X | Δ | Δ |

EXAMPLE 6

| <Ink 9> | |
|---|---|
| Carbon black aqueous dispersion | 20 parts |
| Ethylene-acrylic acid copolymer emulsion (Softening temp.: 75° C., particle size: 0.8 micron) | 80 parts |

The above components were sufficiently mixed under stirring to prepare an ink 9 in a uniform dispersion state.

A 3.5 micron-thick polyester support provided with a heat-resistant protective layer on its back side formed by applying an additional-type silicone resin for release paper at a rate of 0.3 g/m$^2$ followed by drying on heating at 70° C. was provided, and the ink 9 was applied onto a side of the polyester support opposite to that provided with the heat-resistant protective layer to form a 2 micron-thick first ink layer comprising heat-fusible resin particles.

| <Ink 10> | |
|---|---|
| Wax emulsion (Softening temp.: 94° C., average particle size: 1 micron) | 65 parts |
| Ethylene-vinyl acetate-acryl copolymer emulsion (Softening temp.: 88° C., average particle size: about 0.4 micron) | 35 parts |
| Fluorine-containing surfactnat | 1 part |

The above components were sufficiently mixed under stirring to prepare an ink 10 of a solid content of 25%.

The ink 10 was applied on the first ink layer provided above, followed by drying at 60° C., to form a 3 micron-thick second ink layer comprising heat-fusible resin particles. Thus, a thermal transfer material (I) of a structure shown in FIG. 5 was obtained.

EXAMPLE 7

| <Ink 11> | |
|---|---|
| Ethylene-acrylic acid copolymer emulsion (Softening temp.: 75° C., particle size: 0.8 micron) | 80 parts |
| Aqueous acrylic resin solution | 20 parts |

The above components were sufficiently mixed under stirring to prepare an ink 11 in a uniform dispersion state.

A 3.5 micron-thick polyester support provided with a heat-resistant protective layer on its back side formed by applying an addition-type silicone resin for release paper at a rate of 0.3 g/m$^2$ followed by heat drying was provided, and the ink 11 was applied onto a side of the polyester support opposite to that provided with the heat-resistant protective layer followed by drying at 65° C. to form a 2 micron-thick first ink layer comprising heat-fusible resin particles.

| <Ink 12> | |
|---|---|
| Wax emulsion (Softening temp.: 94° C., average particle size: 1 micron) | 40 parts |
| Ethylene-vinyl acetate-acryl copolymer emulsion (Softening temp.: 88° C., average particle size: about 0.4 micron) | 60 parts |
| Carbon black aqueous dispersion | 25 parts |
| Fluorine-containing surfactnat | 1.2 part |

The above components were sufficiently mixed under stirring to prepare an ink 12 of a solid content of 25 %.

The ink 12 was applied on the first ink layer provided above by means of an applicator, followed by drying at 65° C. to form a 3 micron-thick second ink layer comprising heat-fusible resin particles. Thus, a thermal transfer material (J) of a structure shown in FIG. 7 was obtained.

EXAMPLE 8

| <Ink 13> | |
|---|---|
| Carbon black aqueous dispersion | 25 parts |
| Low-molecular weight oxidized polyethylene emulsion (Softening temp.: 85° C., particle size: 0.3 micron) | 80 parts |

The above components were sufficiently mixed under stirring to prepare an ink 13 in a uniform dispersion state.

A 3.5 micron-thick polyester support provided with a heat-resistant protective layer on its back side formed by applying an addition-type silicone resin for release paper at a rate of 0.3 g/m$^2$ followed by drying was provided, and the ink 13 was applied onto a side of the polyester support opposite to that provided with the heat-resistant protective layer followed by drying at 75° C. to form a 2 micron-thick first ink layer comprising heat-fusible resin particles.

| <Ink 14> | |
|---|---|
| Low-molecular weight oxidized polyethylene emulsion (Softening temp.: 110° C., average particle size: about 0.7 micron) | 50 parts |
| Ethylene-vinyl acetate-acryl copolymer emulsion (Softeing temp.: 88° C., average particle size: about 0.4 micron) | 50 parts |
| Fluorine-containing surfactnat | 1 part |

The above components were sufficiently mixed under stirring to prepare an ink 14 of a solid content of 25%.

The ink 14 was applied on the first ink layer provided above by means of an applicator, followed by drying at 85° C. to form a 4 micron-thick second ink layer comprising heat-fusible resin particles and a heat-fusible binder. Thus, a thermal transfer material (K) of a structure shown in FIG. 8 was obtained.

EXAMPLE 9

| <Ink 15> | |
|---|---|
| Ethylene-acrylic acid copolymer emulsion (Softening temp.: 108° C., particle size: 0.8 micron) | 90 parts |
| Polyvinylpyrrolidone aqueous dispersion | 10 parts |
| Carbon black aqueous dispersion | 10 parts |

The above components wrre sufficiently mixed under stirring to prepare an ink 15 in a uniform dispersion state.

A 3.5 micron-thick polyester support provided with a heat-resistant protective layer on its back side formed by applying an addition-type silicone resin for release paper at a rate of 0.3 g/m$^2$ followed by heat drying was provided, and the ink 15 was applied onto a side of the polyester support opposite to that provided with the heat-resistant protective layer followed by drying at 85° C. to form a 2 micron-thick first ink layer comprising heat-fusible resin particles and a heat-fusible binder.

| <Ink 16> | |
|---|---|
| Wax emulsion (Softening temp.: 94° C., average particle size: 1 micron) | 60 parts |
| Ethylene-vinyl acetate copolymer emulsion (Softeing temp.: 75° C., average particle size: about 0.6 micron) | 40 parts |
| Fluorine-containing surfactnat | 1 part |

The above components were sufficiently mixed under stirring to prepare an ink 16 of a solid content of 25%.

The ink 16 was applied on the first ink layer provided above by means of an applicator, followed by drying at 80° C. to form a 3 micron-thick second ink layer comprising heat-fusible resin particles and a heat-fusible binder. Thus, a thermal transfer material (L) of a structure shown in FIG. 9 was obtained.

COMPARATIVE EXAMPLE 4

A thermal transfer material (M) was prepared by applying the ink 3 of Comparative Example 1, followed by drying to form a 3 micron-thick second ink layer on the first ink layer formed in Example 6.

The thus obtained thermal transfer materials (I), (J), (K), (L) and (M) were respectively subjected to thermal transfer recording under the same conditions as used in Example 1. Printing and transfer characteristics were evaluated by naked eye observation, and the results are summarized in the following Table 4.

TABLE

| | THERMAL TRANSFER MATERIAL | EDGE SHARPNESS OF PRINTED IMAGES | PRINTED IMAGE DENSITY | TRANSFER CHARACTERISTIC |
|---|---|---|---|---|
| EXAMPLE 6 | I | ○ | ○ | ○ |
| EXAMPLE 7 | J | ○ | ○-Δ | ○-Δ |
| EXAMPLE 8 | K | ⊙ | ⊙ | ⊙ |
| EXAMPLE 9 | L | ○-Δ | ⊙ | ○ |
| COMPARATIVE EXAMPLE 4 | M | X | Δ | Δ |

In the above table, the symbols respectively have the following meaning:

⊙ : Most excellent for practical use,

○ : Excellent for practical use,

Δ: Applicable to practical use but poor in performance,

X: Not applicable to practical use.

EXAMPLE 10

| <Ink 17> | |
|---|---|
| 20% Wax emulsion (Softening temp.: 70° C.) | 80 parts |
| Pulverized acryl-styrene resin (Softening temp.: 90° C., particle size: 2 microns) | 20 parts |
| Sodium dodecylbenzenesulfonate | 2 parts |
| Water | 198 parts |
| Carbon black aqueous dispersion | 20 parts |

An ink 17 of the above composition was prepared by dissolving the sodium dodecylbenzenesulfonate in the water, adding thereto the pulverized acryl-styrene resin under stirring by means of a propeller-type stirrer, and adding and mixing therewith the other components.

A 3.5 micron-thick polyester support provided with a heat-resistant protective layer on its back side formed by applying an addition-type silicone resin for release paper at a rate of 0.3 g/m$^2$ followed by drying on heating at 70° C. was provided, and the ink 17 was applied onto a side of the polyester support opposite to that provided with the heat-resistant protective layer followed by drying at 95° C. to form a 3 micron-thick first ink layer.

In the first ink layer, two species of nonparticulate phases were confirmed through microscopic observation.

| <Ink 18> | |
|---|---|
| 20% Low-molecular weight oxidized polyethylene aqueous dispersion (Softening temp.: 130° C., particle size: about 2 microns) | 50 parts |
| 20% Acrylic resin emulsion (Softening temp.: 70° C., particle size: about 1 micron) | 50 parts |

The above components were sufficiently mixed under stirring to prepare an ink 18.

The ink 18 was applied on the first ink layer provided above by means of an applicator, followed by drying at 80° C., to form a 3 micron-thick second ink layer containing heat-fusible resin particles, whereby a thermal transfer material (N) of a structure as shown in FIG. 11 was obtained.

In the second ink layer, particles of the low-molecular weight oxidized polyethylene were confirmed through microscopic observation.

EXAMPLE 11

| <Ink 19> | |
|---|---|
| 20% Wax emulsion (Softening temp.: 80° C., particle size: about 2 microns) | 70 parts |
| Aqueous solution of water-soluble acrylic resin (Softening temp: 60° C.) | 30 parts |

The above components were mixed to prepare an ink 19.

A 3.5 micron-thick polyester support provided with a heat-resistant protective layer on its back side formed by applying an addition-type silicone resin for release paper at a rate of 0.3 g/m$^2$ followed by drying on heating at 70° C. was provided, and the ink 19 was applied onto a side of the polyester support opposite to that provided with the heat-resistant protective layer followed by drying at 70° C. to form a 3 micron-thick first ink layer.

In the first ink layer, the wax particles were confirmed through microscopic observation.

| <Ink 20> | |
|---|---|
| 20% Wax emulsion (Softening temp.: 70° C., particle size: 1 micron) | 50 parts |
| Pulverized polyamide resin (Softening temp.: 90° C., particle size: 2 microns) | 50 parts |
| Sodium dodecylbenzenesulfonate | 2 parts |
| Water | 198 parts |

An ink 20 of the above composition was prepared by dissolving the sodium dodecylbenzenesulfonate in the water, adding thereto the pulverized polyamide resin under stirring by means of a propeller-type stirrer, and adding and mixing therewith the wax emulsion.

The ink 20 was applied on the first ink layer provided above by means of an applicator, followed by drying at 90° C. to form a 3 micron-thick second ink layer. Thus, a thermal transfer material (O) was obtained.

COMPARATIVE EXAMPLE 5

A thermal transfer material (H) was prepared by applying the ink 3 of Comparative Example 1, followed by drying to form a 3 micron-thick second ink layer on the first ink layer formed in Example 10.

The thus obtained thermal transfer materials (N), (O) and (P) were respectively subjected to thermal transfer recording under the same conditions as used in Example 1. Printing and transfer characteristics were evaluated by naked eye observation, and the results are summarized in the following Table 5.

TABLE 5

| | THERMAL TRANSFER MATERIAL | EDGE SHARPNESS OF PRINTED IMAGES | PRINTED IMAGE DENSITY | TRANSFER CHARACTERISTIC |
|---|---|---|---|---|
| EXAMPLE 10 | N | ○ | ○ | ○ |
| EXAMPLE 11 | O | ○ | ○ | ○ |
| COMPARATIVE EXAMPLE 5 | P | X | Δ | Δ |

EXAMPLE 12

| <Ink 21> | |
|---|---|
| 20% Wax emulsion (Softening temp.: 70° C.) | 80 parts |
| Pulverized polyamide resin (Softening temp.: 90° C., particle size: 2 microns) | 20 parts |
| Sodium dodecylbenzenesulfonate | 2 parts |
| Water | 198 parts |
| Carbon black aqueous dispersion | 20 parts |

An ink 21 of the above composition was prepared by dissolving the sodium dodecylbenzenesulfonate in the water, adding thereto the pulverized polyamide resin and the carbon black aqueous dispersion under stirring by means of a propeller-type stirrer, and adding and mixing therewith the wax emulsion.

A 3.5 micron-thick polyester support provided with a heat-resistant protective layer on its back side formed by applying an addition-type silicone resin for release paper at a rate of 0.3 g/m$^2$ followed by drying on heating at 70° C. was provided, and the ink 21 was applied onto a side of the polyester support opposite to that provided with the heat-resistant protective layer followed by drying at 95° C. to form a 3 micron-thick first ink layer.

In the first ink layer, two species of nonparticulate phases were confirmed through microscopic observation.

| <Ink 22> | |
|---|---|
| 20% Low-molecular weight oxidized polyethylene aqueous dispersion (Softening temp.: 130° C., particle size: about 2 microns) | 50 parts |
| Vinyl acetate resin emulsion (Softening temp.: 70° C., particle size: 0.5 micron) | 20 parts |
| Acrylic resin emulsion (Softening temp.: 70° C., particle size: about 1 micron) | 20 parts |
| Fluorine-containing surfactant | 1 part |

The above components were sufficiently mixed under stirring to prepare an ink 22.

The ink 22 was applied on the first ink layer provided above by means of an applicator, followed by drying at 105° C., to form a 3 micron-thick second ink layer, whereby a thermal transfer material (Q) was obtained.

In the second ink layer, two species of nonparticulate phases were confirmed through microscopic observation.

COMPARATIVE EXAMPLE 6

A thermal transfer material (R) was prepared by applying the ink 3 of Comparative Example 1, followed by drying to form a 3 micron-thick second ink layer on the first ink layer formed in Example 12.

The thus obtained thermal transfer materials (Q) and (R) were respectively subjected to thermal transfer recording under the same conditions as used in Example 1. Printing and transfer characteristics were evaluated by naked eye observation, and the results are summarized in the following Table 6.

TABLE 6

| | THERMAL TRANSFER MATERIAL | EDGE SHARPNESS OF PRINTED IMAGES | PRINTED IMAGE DENSITY | TRANSFER CHARACTERISTIC |
|---|---|---|---|---|
| EXAMPLE 12 | Q | ○ | ○ | ○ |
| COMPARATIVE EXAMPLE 6 | R | X | Δ | Δ |

EXAMPLE 13

| <Ink 23> | |
|---|---|
| Wax emulsion (Softening temp.: 75° C., particle size: 1 micron) | 100 parts |
| Silicone surfactant | 0.1 part |

The above components were sufficiently mixed to prepare an ink 23.

A 3.5 micron-thick PET support provided with a heat-resistant protective layer on its back side formed by applying an addition-type silicone resin for release paper at a rate of 0.3 g/m$^2$ followed by drying on heating at 70° C. was provided, and the ink 23 was applied onto a side of the polyester support opposite to that provided with the heat-resistant protective layer followed by drying at 70° C. to form a 2 micron-thick first ink layer containing particles.

| <Ink 24> | |
|---|---|
| Oxidized polyethylene aqueous dispersion (Number-average molecular weight 5000, Softening temp.: 140° C., particle size: 1 micron) | 55 parts |
| Polyvinyl acetate aqueous dispersion (Softening temp.: 105° C., particle size: 0.7 micron) | 45 parts |
| Carbon black aqueous dispersion | 25 parts |

The above components were sufficiently mixed under stirring to prepare an ink 24.

The ink 24 was applied on the first ink layer provided above by means of an applicator, followed by drying at 80° C. to form a 4 micron-thick second ink layer containing heat-fusible resin particles. Thus, a thermal transfer material (S) of a structure shown in FIG. 5 was obtained.

EXAMPLE 14

| <Ink 25> | |
|---|---|
| Oxidized polyethylene aqueous dispersion (Number-average molecular weight 2500, Softening temp.: 120° C., particle size: 1 micron) | 85 parts |
| Ethylene-vinyl acetate resin aqueous dispersion (Softening temp.: 105° C., particle size: 0.5 micron) | 15 parts |

The above components were sufficiently mixed to prepare an ink 25. The ink 25 was then applied onto a 3.5 micron-thick PET film back-coated in the same manner as in Example 13, followed by drying at 90° C., to form a 2 micron-thick first ink layer.

| <Ink 26> | |
|---|---|
| Oxidized polyethylene aqueous dispersion (Number-average molecular weight 2500, Softening temp.: 120° C., particle size: 1 micron) | 70 parts |
| Ethylene-vinyl acetate resin aqueous dispersion (Softening temp.: 105° C., particle size: 0.5 micron) | 30 parts |
| Carbon black aqueous dispersion | 20 parts |

The above components were sufficiently mixed to prepare an ink 26. The ink 26 was then applied on the first ink layer provided above, followed by drying at 80° C. to form a 4 micron-thick second ink layer containing heat-fusible resin particles. Thus, a thermal transfer material (T) of a structure shown in FIG. 5 was obtained.

EXAMPLE 15

| <Ink 27> | |
|---|---|
| Wax emulsion (Softening temp.: 80° C., particle size: 1.5 microns) | 90 parts |
| Acrylic resin aqueous dispersion (Softening temp.: 92° C., particle size: 0.6 micron) | 10 parts |

The above components were sufficiently mixed to prepare an ink 27. The ink 27 was then applied onto a 3.5 micron-thick PET film back-coated in the same manner as in Example 13, followed by drying at 65° C., to form a 2 micron-thick first ink layer.

| <Ink 28> | |
|---|---|
| Oxidized polyethylene aqueous dispersion (Number-average molecular weight 2000, Softening temp.: 115° C., particle size: 1 micron) | 40 parts |
| Ethylene-vinyl acetate resin aqueous dispersion (Softening temp.: 110° C., particle size: 0.5 micron) | 40 parts |
| Polyurethane resin aqueous dispersion (Softening temp.: 135° C., particle size: 0.8 micron) | 20 parts |
| Carbon black aqueous dispersion | 20 parts |

The above components were sufficiently mixed under stirring to prepare an ink 28.

The ink 28 was applied on the first ink layer provided above, followed by drying at 80° C. to form a 3 micron-thick second ink layer. Thus, a thermal transfer material (U) of a structure shown in FIG. 5 was obtained.

COMPARATIVE EXAMPLE 7

| <Ink 29> | |
|---|---|
| Carbon black | 12 parts |
| Carnauba wax | 20 parts |
| Paraffin wax | 50 parts |
| Ethylene-vinyl acetate resin | 18 parts |

The above components were mixed in a sand mill for 30 minutes while being heated at 130° C. for dispersing the carbon black to prepare an ink 29. The ink 29 was then applied onto a back-coated 3.5 micron-thick PET film to form a 4 micron-thick ink layer, whereby a thermal transfer material (V) was obtained.

COMPARATIVE EXAMPLE 8

| <Ink 30> | |
|---|---|
| Wax emulsion (Softening temp.: 75° C., particle size: 1 micron) | 100 parts |
| Silicone surfactant | 0.1 part |

The above components were sufficiently mixed to prepare an ink 30. The ink 30 was then applied onto a 3.5 micron-thick PET film back-coated in the same manner as in Example 13, followed by drying at 70° C., to form a 2 micron-thick first ink layer.

| <Ink 31> | |
|---|---|
| Oxidized polyethylene aqueous dispersion (Number-average molecular weight 1100, Softening temp.: 102° C., particle size: 0.8 micron) | 70 parts |
| Polyvinyl acetate aqueous dispersion (Softening temp.: 105° C., particle size: 0.7 micron) | 30 parts |
| Carbon black aqueous dispersion | 20 parts |

The above components were sufficiently mixed to prepare an ink 31. The ink 31 was then applied on the first ink layer provided above, followed by drying at 90° C. to form a 3 micron-thick second ink layer. Thus, a thermal transfer material (M) of a structure shown in FIG. 5 was obtained.

The thus obtained thermal transfer materials (S) - (W) were subjected to thermal transfer recording under the following conditions:

Thermal head: Thin film head, 24 dot arrangement,
Application energy: 35 mJ/mm$^2$,
Recording paper: Bekk smoothness=5 sec.

Printing and transfer characteristics were evaluated by observation with naked eyes. The results are summarized in the following Table 7.

TABLE 7

| | THERMAL TRANSFER MATERIAL | EDGE SHARPNESS OF PRINTED IMAGES | PRINTED IMAGE DENSITY | TRANSFER CHARACTERISTIC |
|---|---|---|---|---|
| EXAMPLE 13 | S | ◎ | ◎ | ◎ |
| EXAMPLE 14 | T | ◎ | ◎ | ◎ |
| EXAMPLE 15 | U | ◎ | ◎ | ◎ |
| COMPARATIVE EXAMPLE 7 | V | X | Δ | Δ |
| COMPARATIVE EXAMPLE 8 | W | Δ | Δ | Δ |

In the above table, the symbols respectively have the following meaning:

◎ : Very excellent for practical use,
Δ: Applicable to practical use but poor in performance,
X: Not applicable to practical use.

What is claimed is:

1. A thermal transfer material, comprising:

a support and a first ink layer and a second ink layer, said ink layers disposed on the support in the order named, each of said first and second ink layers containing a heat-fusible material, wherein said second ink layer comprises domains of at least two species of heat-fusible material in the form of particles.

2. A thermal transfer material according to claim 1, wherein the heat-fusible material in said first ink layer forms a homogenous system.

3. A thermal transfer material according to claim 1, wherein the domains in said second ink layer comprise aggregated heat-fusible resin particles.

4. A thermal transfer material according to claim 1, wherein said first ink layer comprises heat-fusible resin particles.

5. A thermal transfer material according to claim 4, wherein said first ink layer comprise at least one species of heat-fusible resin particles.

6. A thermal transfer material according to claim 5, wherein the domains in said second ink layer comprise heat-fusible resin particles.

7. A thermal transfer material according to claim 1, wherein said first ink layer comprise heat-fusible resin particles and a non-particulate phase.

8. A thermal transfer material according to claim 7, wherein the domains in said second ink layer comprise heat-fusible resin particles.

9. A thermal transfer material according to claim 1, wherein said first ink layer comprises two species of non-particulate phases.

10. A thermal transfer material, comprising: a support, and a first ink layer and a second ink layer respectively containing a heat-fusible material disposed in the order named on the support; at least one of said first and second ink layers comprising domains of at least two species of heat-fusible material in the form of particles, of which at least one species comprises oxidized polyethylene having a number-average molecular weight of not lower than 1300.

11. A thermal transfer material according to claim 10, wherein said oxidized polyethylene has a number-average moleuclar weight of 200–10,000.

* * * * *

UNITED STATES PATENT AND TRADEMARK OFFICE

CERTIFICATE OF CORRECTION

PATENT NO. : 4,783,360

DATED : November 8, 1988

INVENTOR(S) : MASOTO KATAYAMA, ET AL.

It is certified that error appears in the above-identified patent and that said Letters Patent is hereby corrected as shown below:

IN [30] FOREIGN APPLICATION PRIORITY DATA

"Japan.....191847" should read --Japan.....60-191847--.

COLUMN 3

Line 41, "form" should read --forms--.

COLUMN 4

Line 34, "exhibits" should read --exhibit--.
Line 65, "FIG. 7" should read --FIG. 8--.

COLUMN 5

Line 45, "phase" should read --phases--.
Line 65, "fills" should read --films--.

COLUMN 6

Line 52, "a" should read --as--.

COLUMN 7

Line 1, "particular" should read --particulate--.

COLUMN 8

Line 49, "domains heat-" should read
--domains of heat- --.

UNITED STATES PATENT AND TRADEMARK OFFICE

CERTIFICATE OF CORRECTION

PATENT NO. : 4,783,360

DATED : November 8, 1988

INVENTOR(S) : MASOTO KATAYAMA, ET AL.

It is certified that error appears in the above-identified patent and that said Letters Patent is hereby corrected as shown below:

COLUMN 10

Line 16, "heaed" should read --heated--.

COLUMN 12

Line 38, "were," should read --were--.

COLUMN 14

Line 11, "surfactnat" should read --surfactant--.
Line 61, "surfactnat" should read --surfactant--.

COLUMN 15

Line 32, "(Softeing" should read --(Softening--.
Line 34, "surfactnat" should read --surfactant--.
Line 64, "wrre" should read --were--.

COLUMN 16

Line 15, "(Softeing" should read --(Softening--.
Line 16, "surfactnat" should read --surfactant--.
Line 39, "TABLE" should read --TABLE 4--.

COLUMN 18

Line 27, "thermal transfer material (H)" should read --thermal transfer material (P)--.

UNITED STATES PATENT AND TRADEMARK OFFICE

CERTIFICATE OF CORRECTION

PATENT NO. : 4,783,360

DATED : November 8, 1988

INVENTOR(S) : MASOTO KATAYAMA, ET AL. Page 3 of 3

It is certified that error appears in the above-identified patent and that said Letters Patent is hereby corrected as shown below:

COLUMN 22

Line 30, "thermal transfer material (M)" should read --thermal transfer material (W)--.

COLUMN 23

Line 17, "comprise" should read --comprises--.

COLUMN 24

Line 2, "comprise" should read --comprises--.
Line 21, "moleuclar" should read --molecular-- and "200-10,000." should read --2000-10,000.--.

Signed and Sealed this

Twenty-ninth Day of August, 1989

*Attest:*

*Attesting Officer*

DONALD J. QUIGG

*Commissioner of Patents and Trademarks*